US010943749B2

(12) United States Patent
Wisniewski

(10) Patent No.: US 10,943,749 B2
(45) Date of Patent: Mar. 9, 2021

(54) WALL MOUNTED CONTROL DEVICE WITH INTERCHANGEABLE BUTTONS

(71) Applicant: Crestron Electronics, Inc., Rockleigh, NJ (US)

(72) Inventor: Stan Wisniewski, Pompton Plains, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 183 days.

(21) Appl. No.: 15/922,593

(22) Filed: Mar. 15, 2018

(65) Prior Publication Data

US 2019/0287743 A1 Sep. 19, 2019

(51) Int. Cl.

| | |
|---|---|
| ***H01H 23/14*** | (2006.01) |
| ***H01H 13/7057*** | (2006.01) |
| ***H01H 13/83*** | (2006.01) |
| ***H05B 47/19*** | (2020.01) |

(Continued)

(52) U.S. Cl.

CPC ..... *H01H 13/7057* (2013.01); *H01H 13/83* (2013.01); *H01H 23/143* (2013.01); *H05B 47/19* (2020.01); *H01H 9/168* (2013.01); *H05B 47/11* (2020.01)

(58) Field of Classification Search

CPC ..... H01H 13/83; H01H 9/18; H01H 9/22; H01H 9/20; H01H 21/06; H01H 23/143; H01H 23/145; H01H 23/025; H01H 23/30; H01H 23/006

See application file for complete search history.

(56) References Cited

U.S. PATENT DOCUMENTS 1,717,871 A 6/1929 Both
3,036,185 A * 5/1962 Wiley ..... H01H 23/145 200/330

(Continued)

FOREIGN PATENT DOCUMENTS

CA 64543 10/1989
CA 123789 6/2009

(Continued)

OTHER PUBLICATIONS

Lutron Electronics Co., Inc., Palladiom Brochure, P/N 367-2552 REV E, Dec. 2015.

(Continued)

*Primary Examiner* — Felix O Figueroa
(74) *Attorney, Agent, or Firm* — Crestron Electronics, Inc.

(57) ABSTRACT

A control device for controlling at least one associated load and comprising a housing assembly defining a plurality of button zones each comprising at least one switch. The control device further comprises a plurality of interchangeable buttons adapted to be removably attached to the housing assembly over one or more of the button zones. Each button may comprise a front wall and at least one projection extending from a rear surface of the button and adapted to depress an aligned switch when the button is pressed. Each button may also comprise at least one abutment extending from the rear surface of the button and adapted to abut against the front housing portion such that at least a portion of the button pivots or deflect with respect to the at least one abutment when pressed.

20 Claims, 11 Drawing Sheets

(51) Int. Cl.
*H01H 9/16* (2006.01)
*H05B 47/11* (2020.01)

(56) References Cited

U.S. PATENT DOCUMENTS 4,359,619 A * 11/1982 Bergoltz ..... H01H 3/122 174/66
D287,717 S 1/1987 Farwell et al.
D297,404 S 8/1988 Yandek et al.
4,783,581 A 11/1988 Flowers et al.
4,803,380 A 2/1989 Jacoby, Jr. et al.
4,875,880 A 10/1989 Welch et al.
4,972,045 A 11/1990 Primeau
5,073,681 A 12/1991 Hubben et al.
D325,559 S 4/1992 Rosenbaum et al.
D330,013 S 10/1992 Wunsch
D335,867 S 5/1993 Rowen
D336,744 S 6/1993 Kahn et al.
D336,894 S 6/1993 Zaretsky et al.
5,338,909 A * 8/1994 Stanley ..... H01H 23/143 200/339
D351,099 S 10/1994 Flasz
5,457,286 A * 10/1995 Flasz ..... H01H 23/143 174/66
5,696,350 A 12/1997 Anker
5,700,978 A 12/1997 Huff
5,736,965 A 4/1998 Mosebrook et al.
5,744,750 A 4/1998 Almond
D394,042 S 5/1998 Hwang
5,961,345 A 10/1999 Finn et al.
5,982,103 A 11/1999 Mosebrook et al.
5,999,083 A 12/1999 Kordecki
6,005,189 A 12/1999 Anker
D436,930 S 1/2001 Butler
D437,585 S 2/2001 Mayo et al.
D441,722 S 5/2001 Pattberg
D450,043 S 11/2001 Mosebrook
6,380,696 B1 4/2002 Sembhi et al.
6,421,941 B1 7/2002 Finke et al.
6,545,434 B2 * 4/2003 Sembhi ..... H05B 37/029 315/158
D475,024 S 5/2003 Bennett et al.
6,593,530 B2 7/2003 Hunt
6,943,297 B2 9/2005 Capella
D518,794 S 4/2006 Hedderich et al.
D519,939 S 5/2006 Hedderich et al.
D539,758 S 4/2007 Blair et al.
D543,951 S 6/2007 Blair et al.
7,247,792 B2 7/2007 Tufano et al.
D549,710 S 8/2007 Hynecek et al.
D563,326 S 3/2008 Patel et al.
D564,457 S 3/2008 Billings et al.
7,432,463 B2 10/2008 Clegg et al.
7,435,903 B2 10/2008 Tufano et al.
D581,369 S 11/2008 Egea
D596,143 S 7/2009 Felegy, Jr. et al.
7,575,470 B2 8/2009 Pyrros
7,576,285 B1 8/2009 Savicki, Jr.
7,586,040 B1 9/2009 Bala et al.
D602,446 S 10/2009 Felegy, Jr. et al.
7,601,927 B2 * 10/2009 Egea Soler ..... H01H 23/025 200/315
D606,030 S 12/2009 Felegy, Jr. et al.
D606,500 S 12/2009 Snyder et al.
D614,589 S 4/2010 Altonen et al.
D620,457 S 7/2010 Maurer et al.
7,781,690 B2 8/2010 Ishii
D626,092 S 10/2010 Clymer et al.
D627,309 S 11/2010 Snyder et al.
D631,856 S 2/2011 Altonen et al.
7,884,297 B2 * 2/2011 Okuzumi ..... H01H 23/143 200/315
D633,448 S 3/2011 Biery et al.
D633,874 S 3/2011 Feldstein et al.
D636,347 S 4/2011 Felegy, Jr. et al.
D636,351 S 4/2011 Rodriguez et al.
D638,375 S 5/2011 Clymer et al.
D638,805 S 5/2011 Clymer et al.
7,939,756 B2 5/2011 Daniels et al.
D645,413 S 9/2011 Lind, III et al.
D647,489 S 10/2011 Lind, III et al.
D649,123 S 11/2011 Jacoby et al.
D649,125 S 11/2011 Clymer et al.
D649,520 S 11/2011 Jacoby et al.
D654,030 S 2/2012 Hoffknecht et al.
8,149,591 B2 * 4/2012 Feldstein ..... H01H 9/0271 361/810
8,242,364 B1 8/2012 Shotey et al.
D669,866 S 10/2012 Gilbert et al.
8,289,716 B2 * 10/2012 Patel ..... H01H 3/122 361/728
D673,510 S 1/2013 Felegy, Jr. et al.
8,350,154 B1 1/2013 Shotey
8,420,956 B2 4/2013 Alderson et al.
D687,390 S 8/2013 McDonald et al.
D691,097 S 10/2013 Lind, III et al.
D694,196 S 11/2013 Felegy, Jr. et al.
D694,716 S 12/2013 Felegy, Jr. et al.
D703,623 S 4/2014 Altonen et al.
D705,741 S 5/2014 Porter et al.
D706,731 S 6/2014 Altonen et al.
D706,732 S 6/2014 Altonen et al.
D711,837 S 8/2014 Clymer et al.
D711,838 S 8/2014 Spira
D714,231 S 9/2014 Sparks et al.
D714,232 S 9/2014 Chambers et al.
D714,234 S 9/2014 Altonen et al.
D714,736 S 10/2014 O'Donnell
D715,231 S 10/2014 O'Donnell
D717,742 S 11/2014 Larkin et al.
D720,306 S 12/2014 Altonen et al.
D721,659 S 1/2015 Rodriguez et al.
D726,663 S 4/2015 Clymer et al.
D733,073 S 6/2015 Larkin et al.
D733,076 S 6/2015 Jacoby et al.
9,048,647 B2 6/2015 Myers et al.
D733,668 S 7/2015 Altonen et al.
D734,277 S 7/2015 Jacoby et al.
D736,718 S 8/2015 Spira
D737,154 S 8/2015 Jacoby et al.
D737,222 S 8/2015 Altonen et al.
D739,830 S 9/2015 Spira
D750,981 S 3/2016 Jacoby et al.
9,300,121 B2 3/2016 Myers et al.
D755,732 S 5/2016 Moeller
D755,739 S 5/2016 Altonen et al.
9,401,252 B2 * 7/2016 Keirstead ..... H01H 23/04
D762,590 S 8/2016 Clymer et al.
9,578,720 B2 2/2017 Camden et al.
9,608,418 B1 * 3/2017 Elberbaum ..... H02G 3/16
9,609,719 B2 3/2017 Camden et al.
9,652,979 B2 5/2017 Camden et al.
9,679,696 B2 6/2017 Bhutani et al.
D792,358 S 7/2017 Poulheim et al.
9,699,864 B2 7/2017 Camden et al.
9,717,130 B2 7/2017 Shivell et al.
9,742,580 B2 8/2017 Camden et al.
D797,545 S 9/2017 Poulheim et al.
D797,683 S 9/2017 Poulheim et al.
D797,684 S 9/2017 Poulheim et al.
9,763,302 B2 9/2017 McDonald et al.
D799,934 S 10/2017 Poulheim et al.
D800,669 S 10/2017 Poulheim et al.
D800,671 S 10/2017 Poulheim et al.
D800,672 S 10/2017 Poulheim et al.
9,965,047 B2 * 5/2018 Kirkpatrick ..... G06F 3/0238
10,109,433 B2 * 10/2018 Bleckmann ..... H01H 3/122
2005/0043907 A1 2/2005 Eckel et al.
2008/0237010 A1 * 10/2008 Patel ..... H01H 13/705 200/314
2012/0268901 A1 * 10/2012 Jeschko ..... H01H 23/06 361/747
2013/0020187 A1 * 1/2013 Chen ..... H01H 23/143 200/520

(56) References Cited

U.S. PATENT DOCUMENTS

| | | | |
|---|---|---|---|
| 2015/0346702 | A1 | 12/2015 | Camden et al. |
| 2016/0069537 | A1 | 3/2016 | Dimberg et al. |
| 2016/0073467 | A1 | 3/2016 | McDonald et al. |
| 2016/0307714 | A1 | 10/2016 | Bhate et al. |
| 2016/0353543 | A1 | 12/2016 | Twaddell et al. |
| 2017/0053753 | A1 | 2/2017 | Adams et al. |
| 2017/0169702 | A1 | 6/2017 | Camden et al. |
| 2017/0229010 | A1 | 8/2017 | Camden et al. |
| 2017/0237173 | A1 | 8/2017 | Bhutani et al. |
| 2017/0238395 | A1 | 8/2017 | Shivell et al. |
| 2017/0257927 | A1 | 9/2017 | Camden et al. |

FOREIGN PATENT DOCUMENTS

| | | |
|---|---|---|
| CA | 123790 | 6/2009 |
| EP | 000253737-0007 | 2/2005 |
| EP | 000253737-0011 | 2/2005 |
| EP | 000511720-0007 | 5/2006 |
| EP | E0000508171-0001 | 5/2006 |
| EP | 000536990-0012 | 8/2006 |
| EP | 000578612-0003 | 10/2006 |
| EP | 002031070-0001 | 4/2012 |
| EP | E0002031021-0001 | 4/2012 |
| EP | 002167098-0001 | 1/2013 |
| EP | 002578039-0001 | 3/2015 |
| EP | 002578039-0002 | 3/2015 |
| EP | 002578039-0003 | 3/2015 |
| EP | 002627950-0001 | 5/2015 |
| EP | 002627992-0001 | 5/2015 |
| GB | 2082690 | 4/1999 |
| GB | 4006871 | 3/2008 |
| IN | 253519 | 11/2013 |
| KR | 300764224 | 9/2014 |
| WO | 064785 | 12/2003 |

OTHER PUBLICATIONS

Insteon, Keypad Dimmer Owner's Manual 2334-222, Rev: Jul. 25, 2013 9:16 AM.
Insteon, Remote Control Keypad Switch Model: 2486D—8-button, Quick Start Guide, 2012.
Philips Color Kinetics, Controller Keypad, Wall-mounted keypad for triggering iPlayer 3 light shows, DAS-000016-01 R05, 04-12.
Crestron Electronics, Inc., CLWI-KPLCN, Specifications subject to change without notice. Revised Jun. 2, 2016.
Crestron Electronics, Inc., CLWI-KPLCN, In-Wall Lighting Keypad, Cresnet® Installation Guide, DOC. 7242A (2031639) 08.13.
INSTEON, KeypadLinc, V2 Dimmer, Rev 051205, 2005.
Philips Solid-State Lighting Solutions, Inc., Controller Keypad 103-000020-00, 2016.
PCS PulseWorx, UPB Wall Controller, 7 Button, Item # PCKPCW7x, 2016.
PCS PulseWorx, KPC7, Keypad Controller 7 Button, 2013.
PCS PulseWorx, KPC 7-Button Controller Manual Configuration Guide, Version 1.0 Oct. 1, 2013.
Control4 Lighting Equipment, available at www.c9ny.com/products/c4/lighting, accessed on Sep. 21, 2016.
Digital Lumens Incorporated, LightRules, Hardware Components, available at www.documentation.digitallumens.com/Content/LightRules/Admin%20Guide-English/LightRules%20Overview/Hardware%20Components.htm, accessed on Sep. 21, 2016.
Insteon, Insteon Remote Control Dimmer Keypad, 6-Button-White, available at www.smarthome.com/insteon-2334-232-keypad-dimmer-switch-dual-band-6-button-white.html, accessed on Sep. 21, 2016.
Lutron Electronics Co., Inc., PalladiomTM QS Keypads, Installation Instruction, P/N 041496 Rev. D, Oct. 2015.
Lutron Electronics Co., Inc., HomeWorks® QS Wired PalladiomTM Keypad, product specifications 369881d Nov. 23, 2015.
U.S. Appl. No. 29/293,669, filed Dec. 4, 2007, titled "Lighting control keypad", Abandoned.

* cited by examiner

WALL MOUNTED CONTROL DEVICE WITH INTERCHANGEABLE BUTTONS

BACKGROUND OF THE INVENTION

Technical Field

Aspects of the embodiments relate to wall mounted control devices, and more specifically to a wall mounted control device with interchangeable buttons.

Background Art

The popularity of home and building automation has increased in recent years partially due to increases in affordability, improvements, simplicity, and a higher level of technical sophistication of the average end-user. Generally, automation systems integrate various electrical and mechanical system elements within a building or a space, such as a residential home, commercial building, or individual rooms, such as meeting rooms, lecture halls, or the like. Examples of such system elements include heating, ventilation and air conditioning (HVAC), lighting control systems, audio and video (AV) switching and distribution, motorized window treatments (including blinds, shades, drapes, curtains, etc.), occupancy and/or lighting sensors, and/or motorized or hydraulic actuators, and security systems, to name a few.

One way a user can be given control of an automation system, is through the use of one or more control devices, such as a keypad. A keypad is typically mounted in a recessed receptacle in a building wall, commonly known as a wall or a gang box, and comprises one or more buttons or keys each assigned to perform a predetermined or assigned function. Assigned functions may include, for example, turning various types of loads on or off, or sending other types of commands to the loads, for example, orchestrating various lighting presets or scenes of a lighting load. Typically, the various buttons are removable and may be printed with indicia to either identify its respective function or the controlled load. However, typically such keypads offer crude designs with bulky buttons or with buttons which are difficult to assemble.

Accordingly, a need has arisen for an apparatus, system, and method for an aesthetically pleasing wall mounted control device with interchangeable buttons.

SUMMARY OF THE INVENTION

It is an object of the embodiments to substantially solve at least the problems and/or disadvantages discussed above, and to provide at least one or more of the advantages described below.

It is therefore a general aspect of the embodiments to provide an apparatus, system, and method for a wall mounted control device with interchangeable buttons, which will obviate or minimize problems of the type previously described.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to one aspect of the embodiments, a control device is provided adapted to control at least one function of at least one associated load. The control device comprise a housing assembly and a plurality of buttons. The housing assembly comprises a front housing portion including a front wall defining a plurality of button zones disposed along the front wall. Each button zone comprises at least one switch. Each of the plurality of buttons are adapted to be removably attached to the front housing portion over one or more of the button zones. Each button comprises a front wall comprising a height adapted to substantially cover the at least one button zone and a width wider than the front housing portion. Each button is adapted to depress the aligned switch when the button is pressed.

According to an embodiment, the front housing portion may comprise a pair of side walls laterally disposed with respect to the front wall of the front housing portion. Each button may comprise a pair of side walls laterally and rearwardly extending from the button's front wall, wherein the button removably attaches to the front housing portion whereby the button side walls envelop the side walls of the front housing portion. According to an embodiment, each side wall of the front housing portion comprises at least one recessed shoulder, wherein each button side wall comprises at least one arm laterally and inwardly extending from the side wall, wherein the button removably attaches to the front housing portion whereby the at least one arm on each button side wall engages the at least one recessed shoulder in a respective side wall of the front housing portion. According to a further embodiment, each side wall of the front housing portion comprises a plurality of recessed shoulders each aligned with one of the button zones.

According to another embodiment, wherein each button zone comprises at least one button alignment orifice extending through the front wall for the front housing portion, and wherein each button comprises at least one alignment post adapted to align with and inserted through the at least one alignment orifice of the respective button zone such that the button is substantially prevented from being displaced in a horizontal or vertical direction.

According to a further embodiment, each button zone comprises at least one light source and wherein each button comprises an opaque area and a transparent or translucent area adapted to permit light from the light source to pass therethrough. According to an embodiment, the control device further comprises a plurality of longitudinally extending light bars each positioned adjacent the at least one light source at one of the button zones, wherein the front wall of the front housing portion comprises a plurality of openings extending traversely therethrough and each sized to receive at least a front portion of one of the light bars, wherein each light bar comprises a material adapted to distribute light from the respective at least one light source. According to an embodiment, the at least one light source at one of the button zones comprises a pair of oppositely disposed light sourced aligned with and adapted to direct light to side edges of a rear portion of the one of the light bars.

According to an embodiment, the control device further comprises a printed circuit board disposed behind the front wall of the front housing portion, wherein at each area aligned with one of the button zones the printed circuit board comprises the at least one switch, at least one light source adapted to provide backlighting to the button zone, and at least one alignment orifice adapted to receive an alignment post extending from one of the buttons, wherein the front wall of the front housing portion comprises openings aligned with the switches, light sources, and alignment orifices on the printed circuit board.

According to an embodiment, at least one of the buttons comprises a single press button adapted to depress one of the at least one switches in one of the button zones. According to another embodiment, at least one of the buttons comprises a rocker bottom adapted to depress two switches in at least one of the button zones. Furthermore, at least one of the buttons may comprise a single zone height button adapted to cover and attach over a single button zone. At least one of the buttons may comprise a multi-zone height button adapted to cover and attach over at least two adjacent button zones. The multi-zone height button may comprise a multi-zone single press button adapted to depress one of the switches in one of the button zones. According to another embodiment, the multi-zone height button may comprise a multi-zone rocker button adapted to depress two switches in two different button zones. According to an embodiment, the single zone and multi-zone height buttons are interchangeably received by the one or more of the button zones to provide a plurality of button configurations.

According to an embodiment, each button may comprise at least one projection extending from a rear surface of the button at a location aligned with the at least one switch of the at least one button zone and adapted to depress the aligned switch when the button is pressed.

According to another embodiment, each button comprises at least one abutment extending from a rear surface of the button, wherein the at least one abutment is adapted to abut against the front wall of the front housing portion such that at least a portion of the button pivots or deflect with respect to the at least one abutment when pressed. The at least one abutment may comprise a pair of oppositely disposed abutments adapted to cause the at least one button to deflect when pressed at a location between the abutments. According to one embodiment, the at least one abutment on at least one button may longitudinally extend along a horizontal pivot axis adapted to cause at least one side of the at least one button to pivot or deflect about the horizontal pivot axis when pressed. According to another embodiment, the at least one abutment on at least one button longitudinally extends along a vertical pivot axis adapted to cause at least one side of the at least one button to pivot or deflect about the vertical pivot axis when pressed.

According to an embodiment, the control device further comprises a faceplate comprising an opening defined by a pair of vertical side walls, a horizontal top wall, and a horizontal bottom wall, wherein the opening is sized to receive the width of at least one button therein. According to an embodiment, the front surface of each button is adapted to be substantially flush with a front surface of the faceplate. The horizontal top wall and the horizontal bottom wall of the faceplate may be recessed back from the pair of vertical side walls of the faceplate and each is adapted to removably receive a decorative trim plate thereon, wherein a front surface of each button is adapted to be substantially flush with a front surface of the pair of vertical side walls of the faceplate and a front surface of each decorative trim plate.

According to an embodiment, when a plurality of control devices are ganged adjacent to each other, a set of buttons of one control device are adapted to be disposed adjacent to a set of buttons of an adjacent control device forming substantially no space therebetween. According to a further embodiment, the housing assembly may further comprise a rear housing portion attached to the front housing portion and adapted to fit within a standard electrical box.

According to another aspect of the embodiments, a control device is provided adapted to control at least one function of at least one associated load. The control device comprises a housing assembly comprising a front housing portion including a front wall defining a plurality of button zones disposed along the front wall, wherein each button zone comprises at least one switch and at least one button alignment orifice extending through the front wall of the front housing portion. The control device further comprises a plurality of buttons each adapted to be removably attached to the front housing portion over one or more of the button zones. Each button may comprise a front wall, at least one projection, at least one alignment post, and at least one abutment. The at least one projection may extend from a rear surface of the button and may be adapted to be aligned with at least one switch of one of the button zones to depress the aligned switch when the button is pressed. The at least one alignment post is adapted to be aligned with and inserted through at least one alignment orifice of one of the button zones. The at least one abutment may extend from the rear surface of the button, wherein the at least one abutment is adapted to abut against the front wall of the front housing portion such that at least a portion of the button pivots or deflect with respect to the at least one abutment when pressed. The buttons may comprise a single zone height button comprising a height adapted to substantially cover and attach over a single button zone, and wherein the buttons comprise at least one multi-zone height button adapted to substantially cover and attach over at least two adjacent button zones.

According to a further aspect of the embodiments, a control device is provided adapted to control at least one function of at least one associated load. The control device comprises a housing assembly comprising a front housing portion including a front wall and a pair of side walls laterally disposed with respect to the front wall, wherein each side wall comprises at least one recessed shoulder, wherein the front housing portion comprises a plurality of switches. The control device further comprise a plurality of buttons each comprising a front wall and a pair of side walls laterally and rearwardly extending from the front wall, wherein each button side wall comprises at least one arm laterally and inwardly extending from the button side wall. Each button may comprise a width wider than the front housing portion, wherein each button is adapted to removably attach to the housing assembly whereby the at least one arm on each side wall of the button engages the at least one recessed shoulder in a respective side wall of the front housing portion, and wherein each button is adapted to engage at least one switch on the front housing portion.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWINGS

Figure 1:
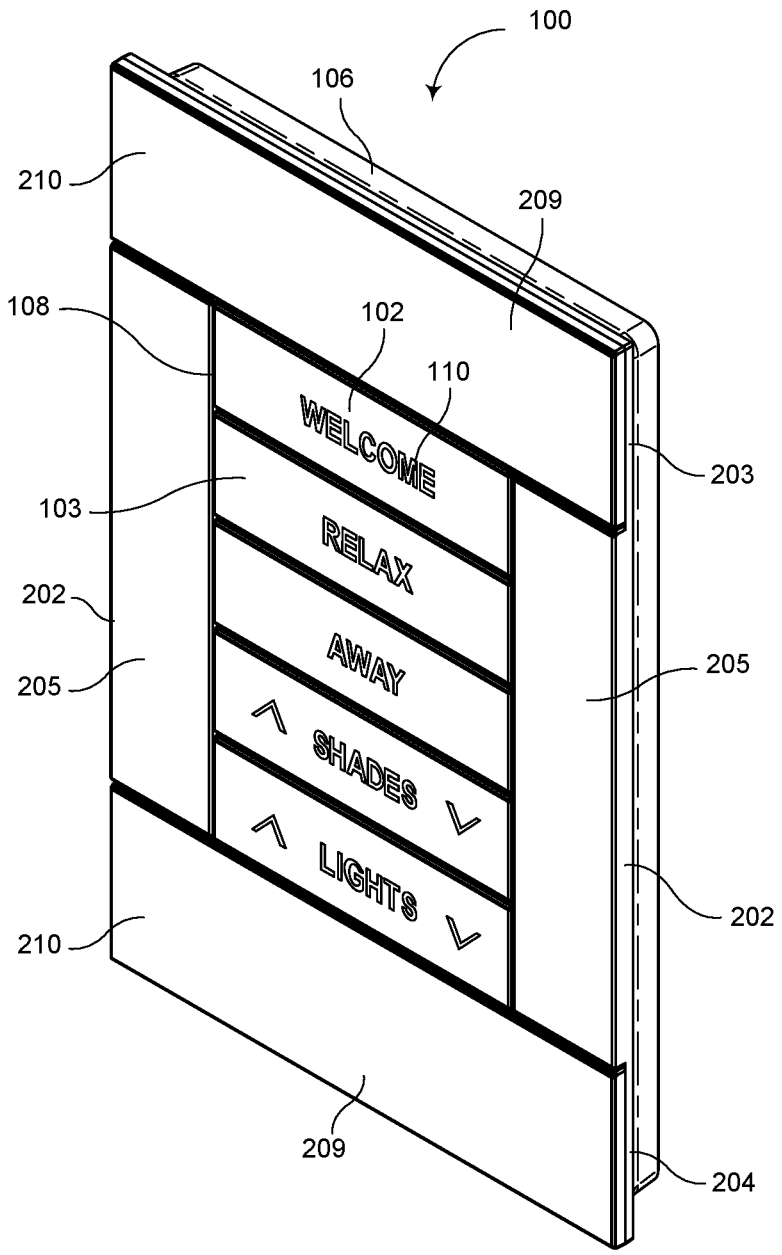

FIG. 1 illustrates a perspective front view of an illustrative wall mounted control device according to an illustrative embodiment.

Figure 2:
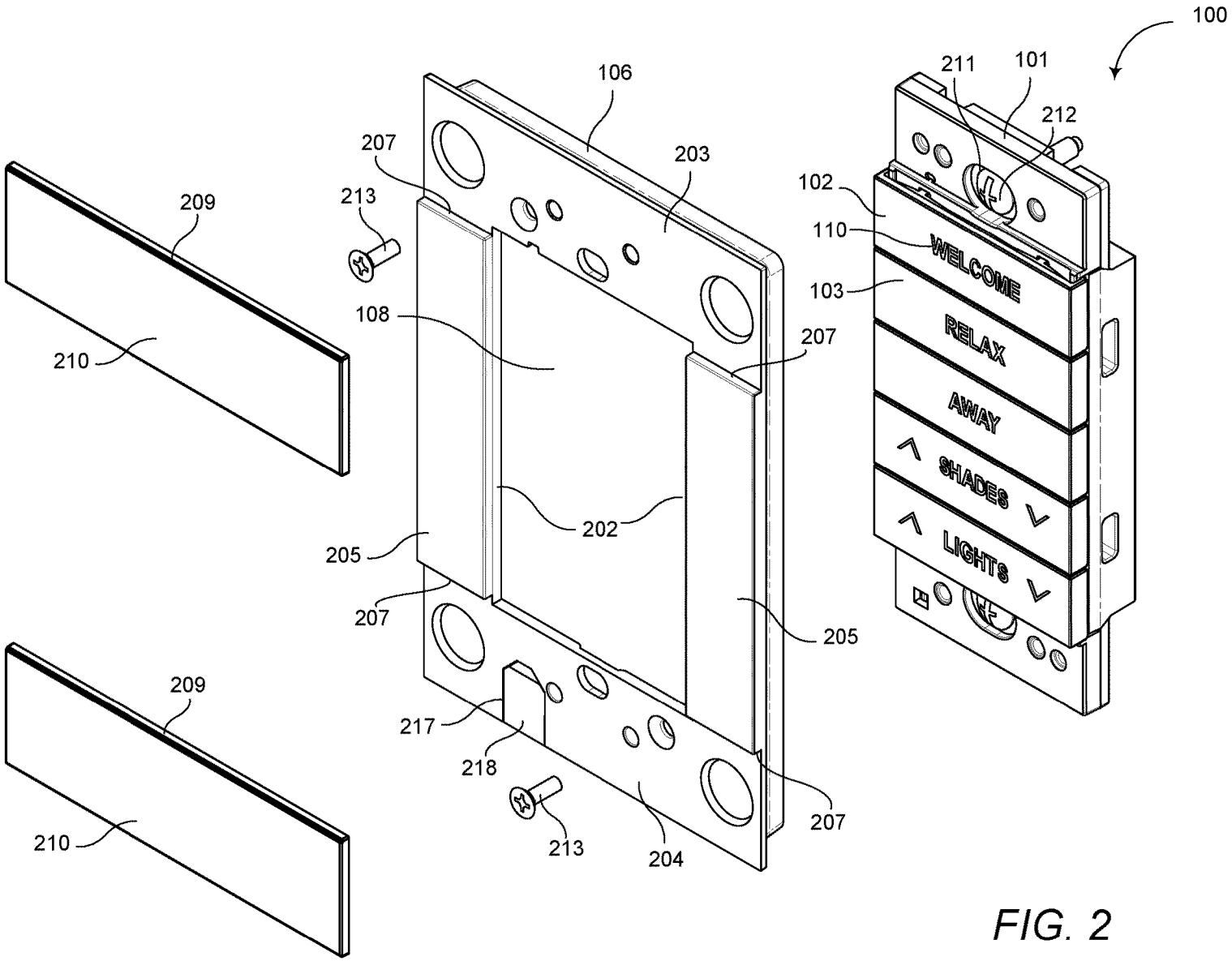

FIG. 2 illustrates a perspective front view of the control device with the faceplate removed according to an illustrative embodiment.

Figure 3:
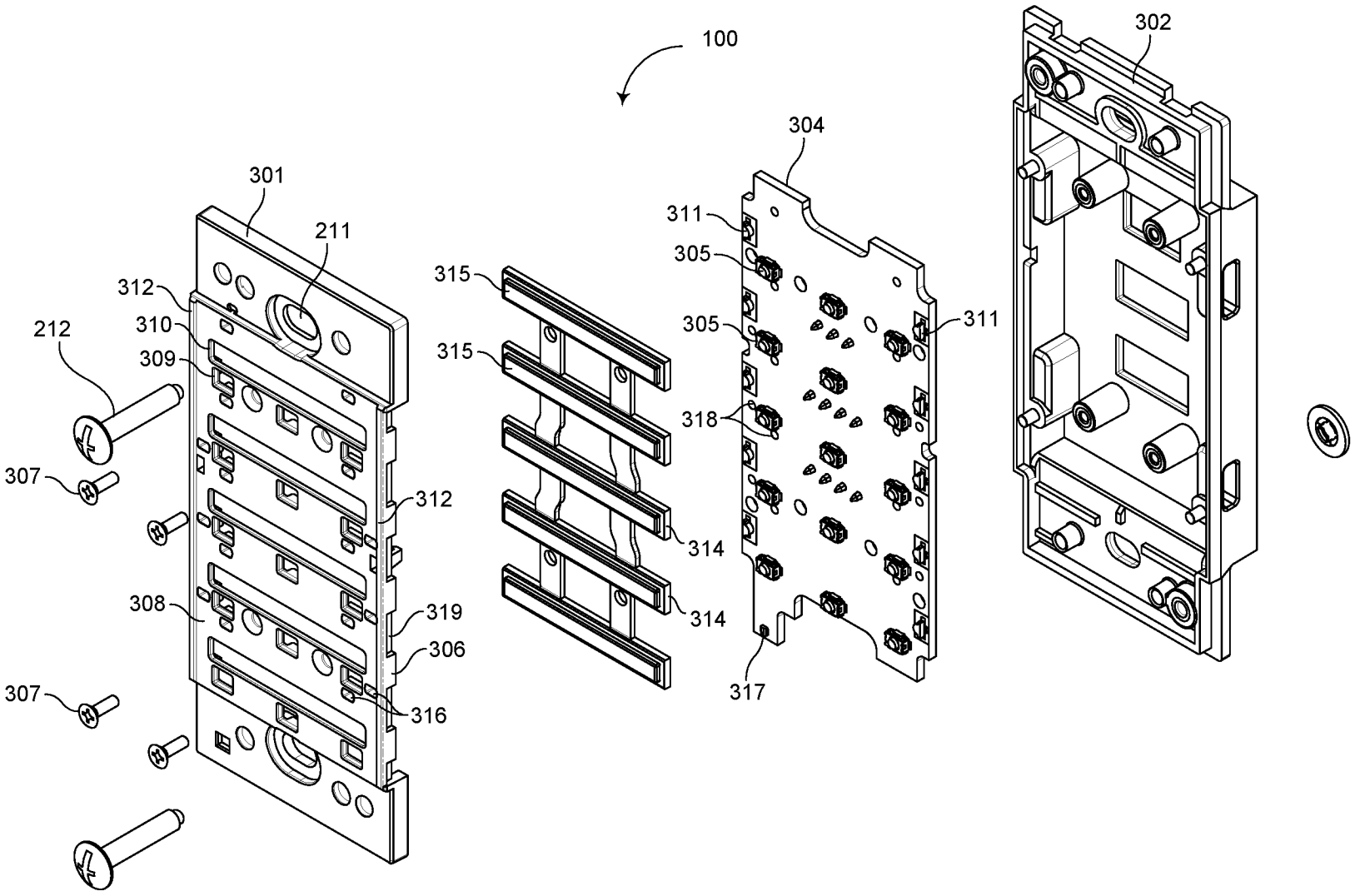

FIG. 3 illustrates an exploded perspective front view of the control device according to an illustrative embodiment.

Figure 4:
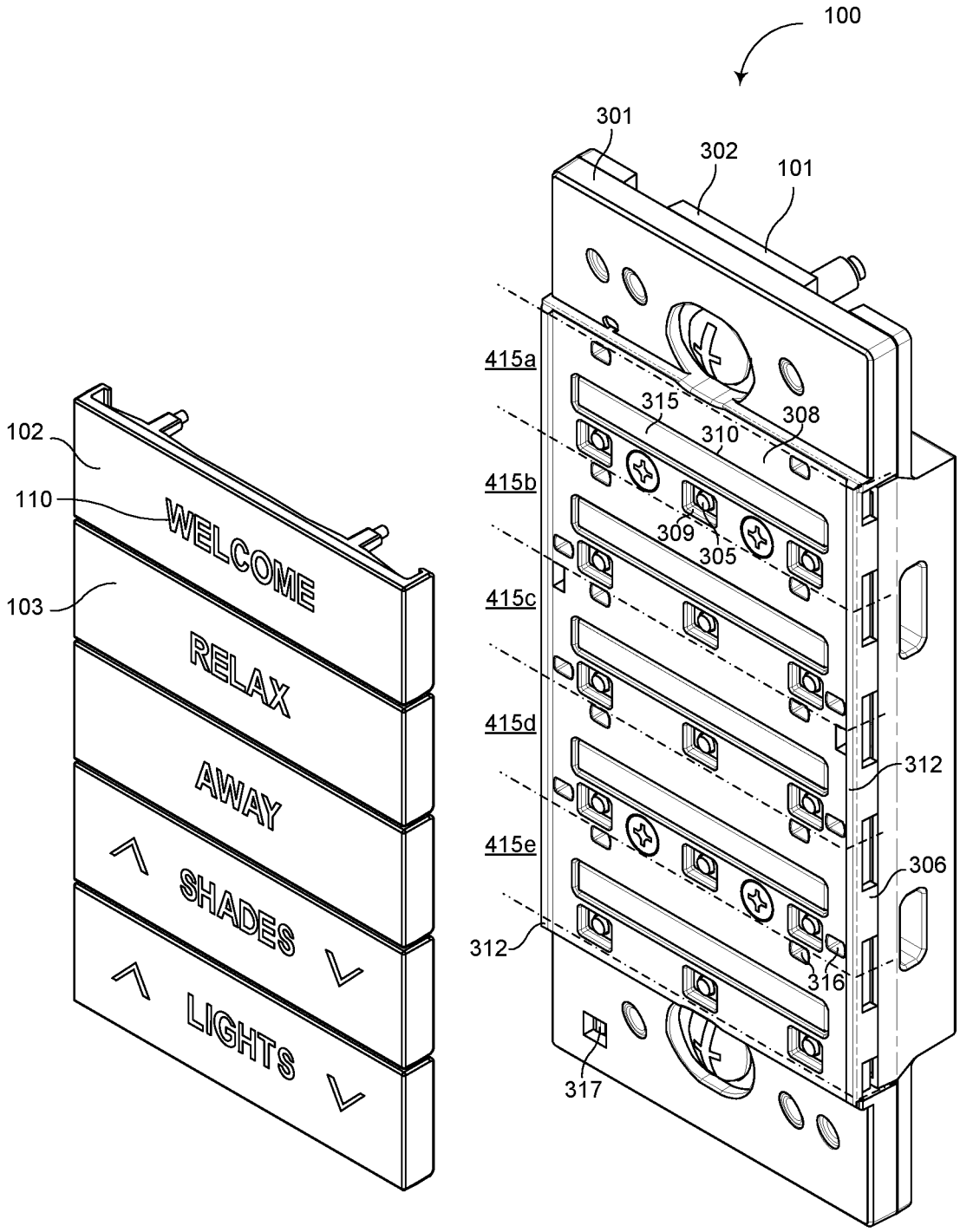

FIG. 4 illustrates a perspective view of the control device with the buttons removed according to an illustrative embodiment.

Figure 5A:
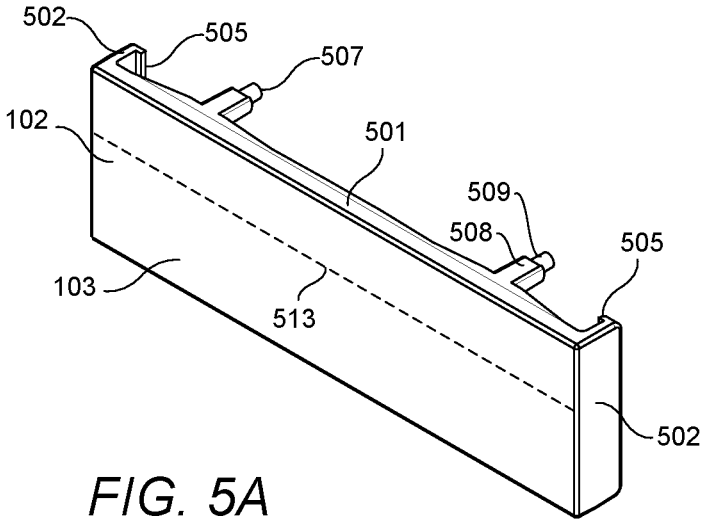

FIG. 5A illustrates a front perspective view of a single height button according to an illustrative embodiment.

Figure 5B:
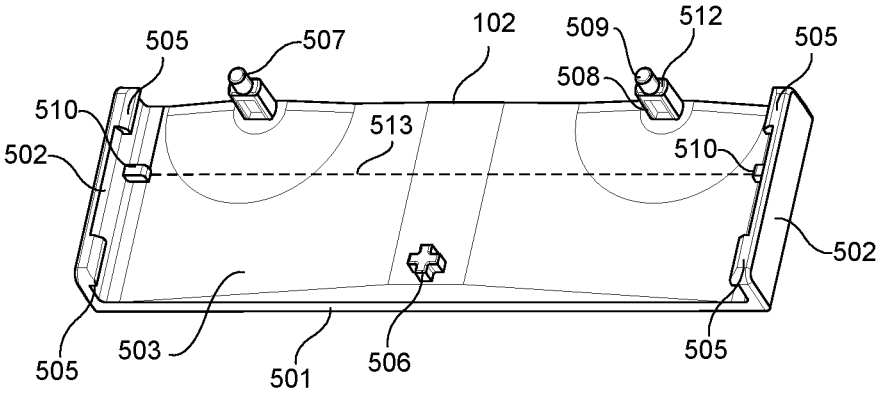

FIG. 5B illustrates a rear perspective view of the single height button according to an illustrative embodiment.

Figure 5C:
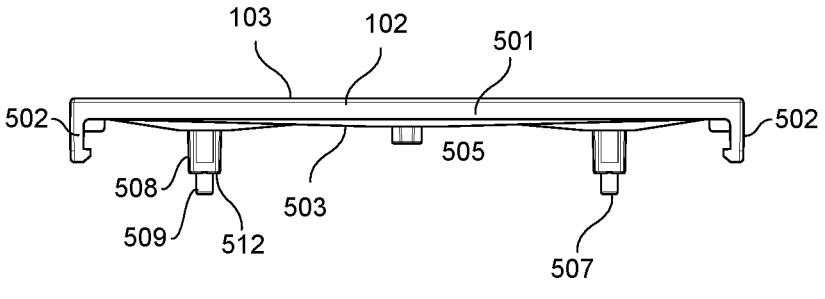

FIG. 5C illustrates a top view of the single height button according to an illustrative embodiment.

Figure 5D:
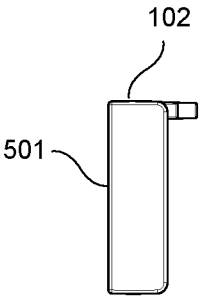

FIG. 5D illustrates a side view of the single height button according to an illustrative embodiment.

Figure 6A:
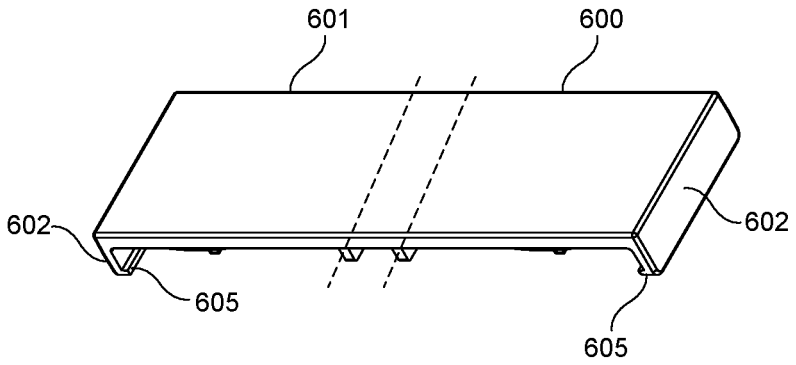

FIG. 6A illustrates a front perspective view of a single height rocker button according to an illustrative embodiment.

Figure 6B:
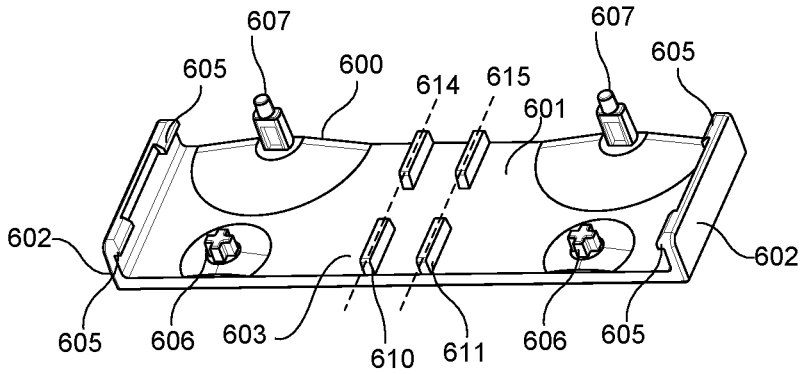

FIG. 6B illustrates a rear perspective view of the single height rocker button according to an illustrative embodiment.

Figure 7A:
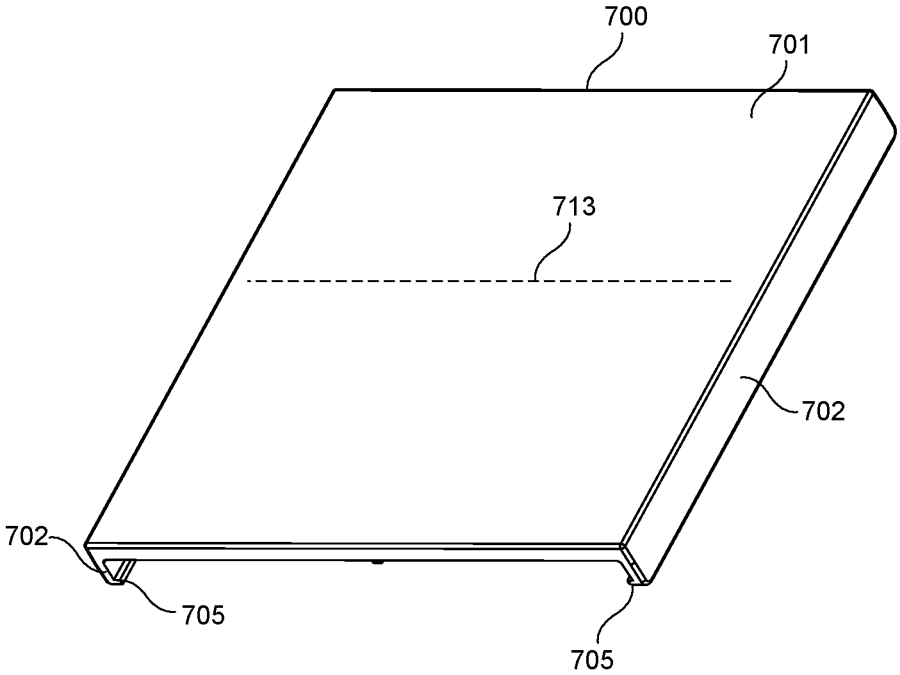

FIG. 7A illustrates a front perspective view of a three height rocker button according to an illustrative embodiment.

Figure 7B:
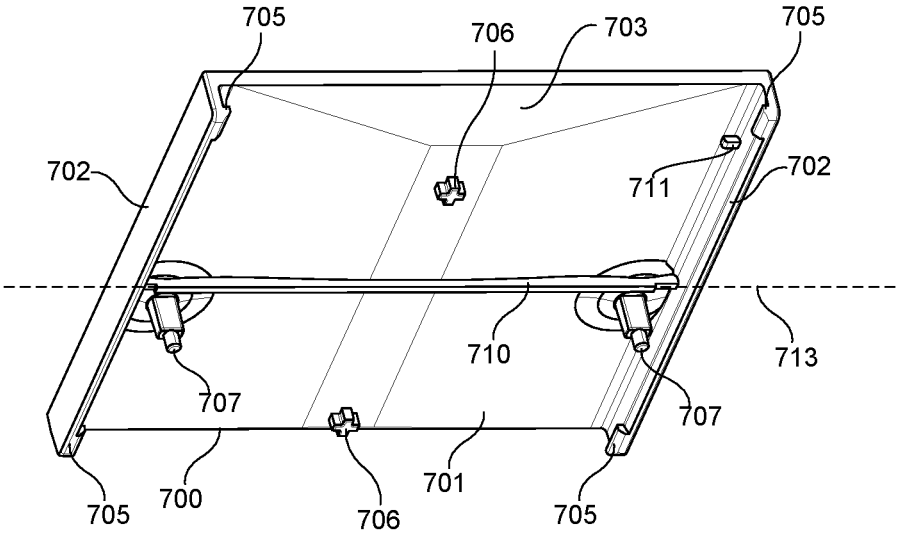

FIG. 7B illustrates a rear perspective view of the three height rocker button according to an illustrative embodiment.

Figure 8A:
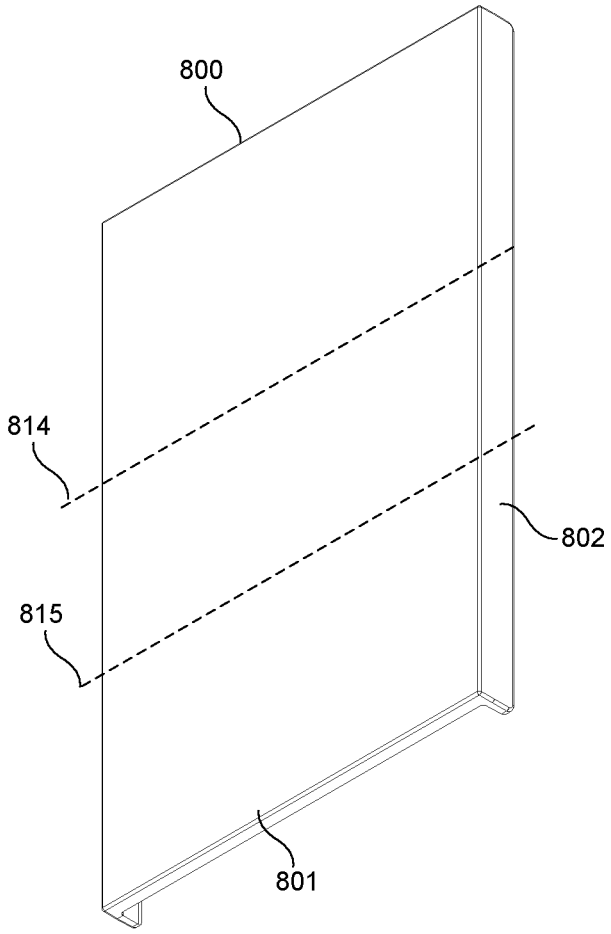

FIG. 8A illustrates a front perspective view of the five height rocker button according to an illustrative embodiment.

Figure 8B:
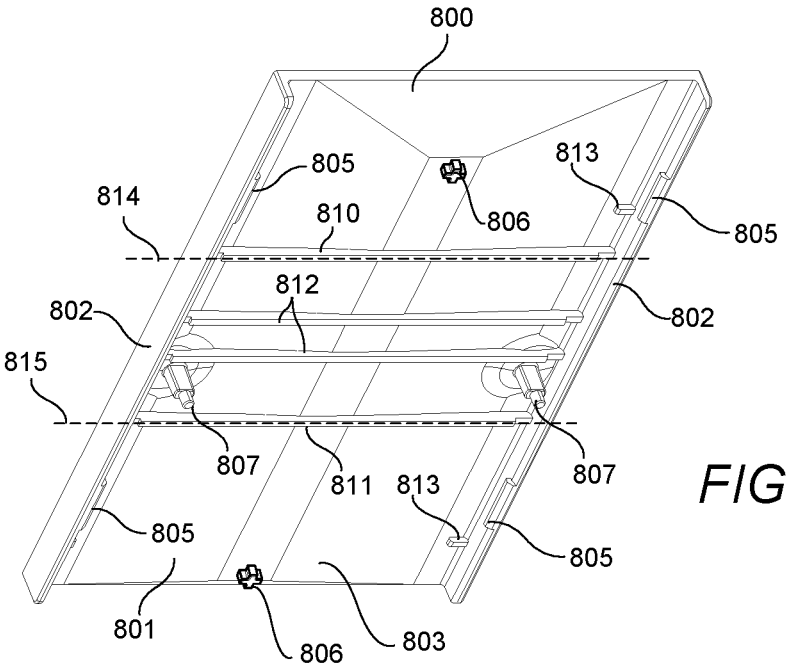

FIG. 8B illustrates a rear perspective view of the five height rocker button according to an illustrative embodiment.

Figure 9A:
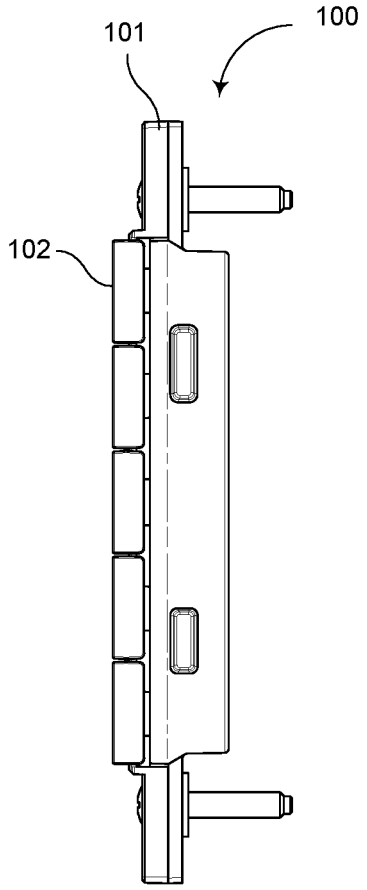

FIG. 9A illustrates a side view of the control device according to an illustrative embodiment.

Figure 9B:
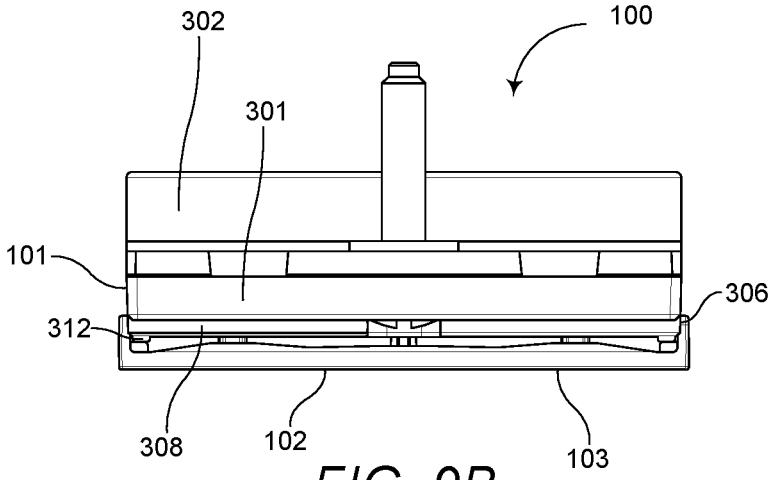

FIG. 9B illustrates a top view of the control device according to an illustrative embodiment.

Figure 10:
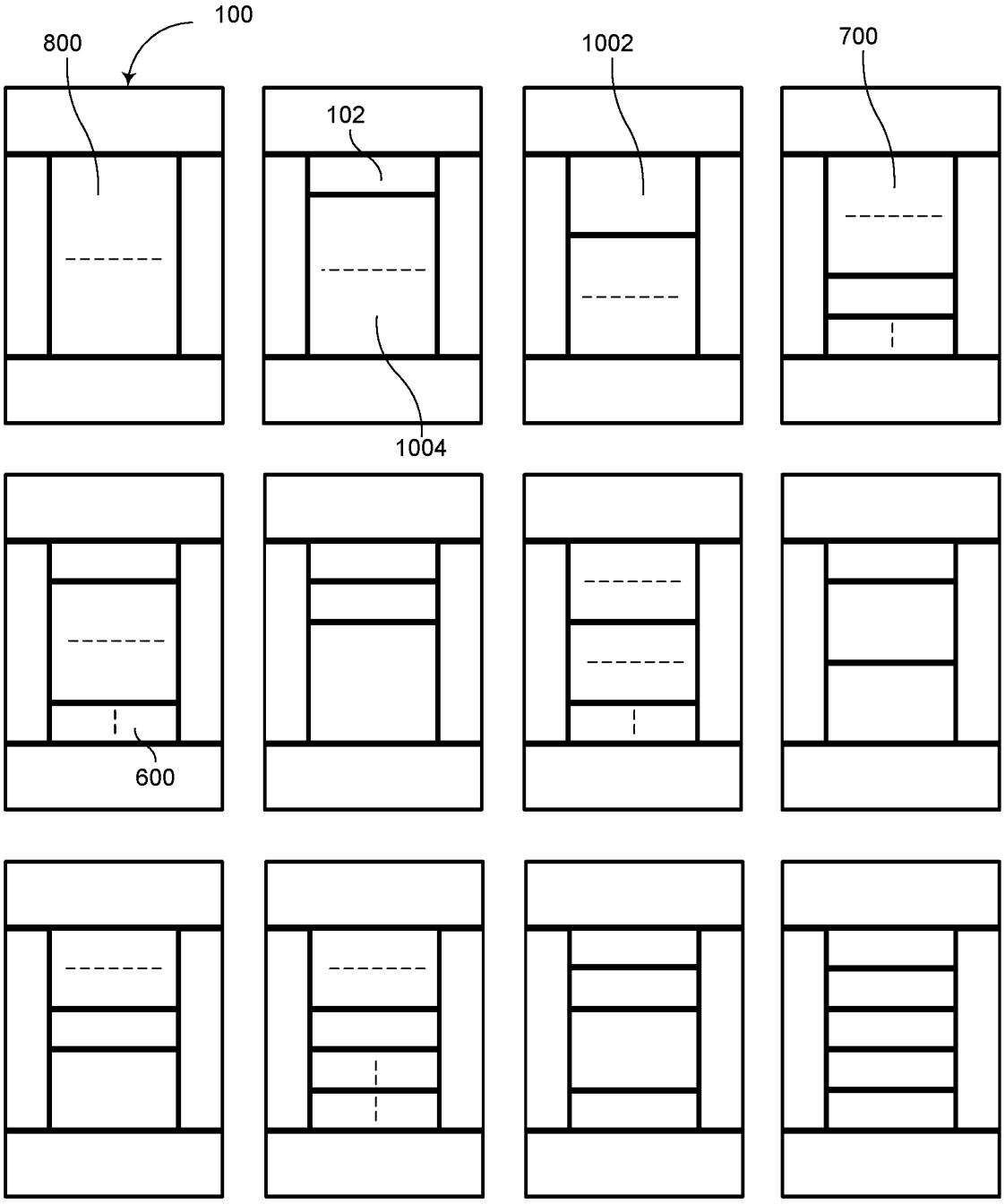

FIG. 10 illustrates various possible button configurations of the control device according to an illustrative embodiment.

Figure 11:
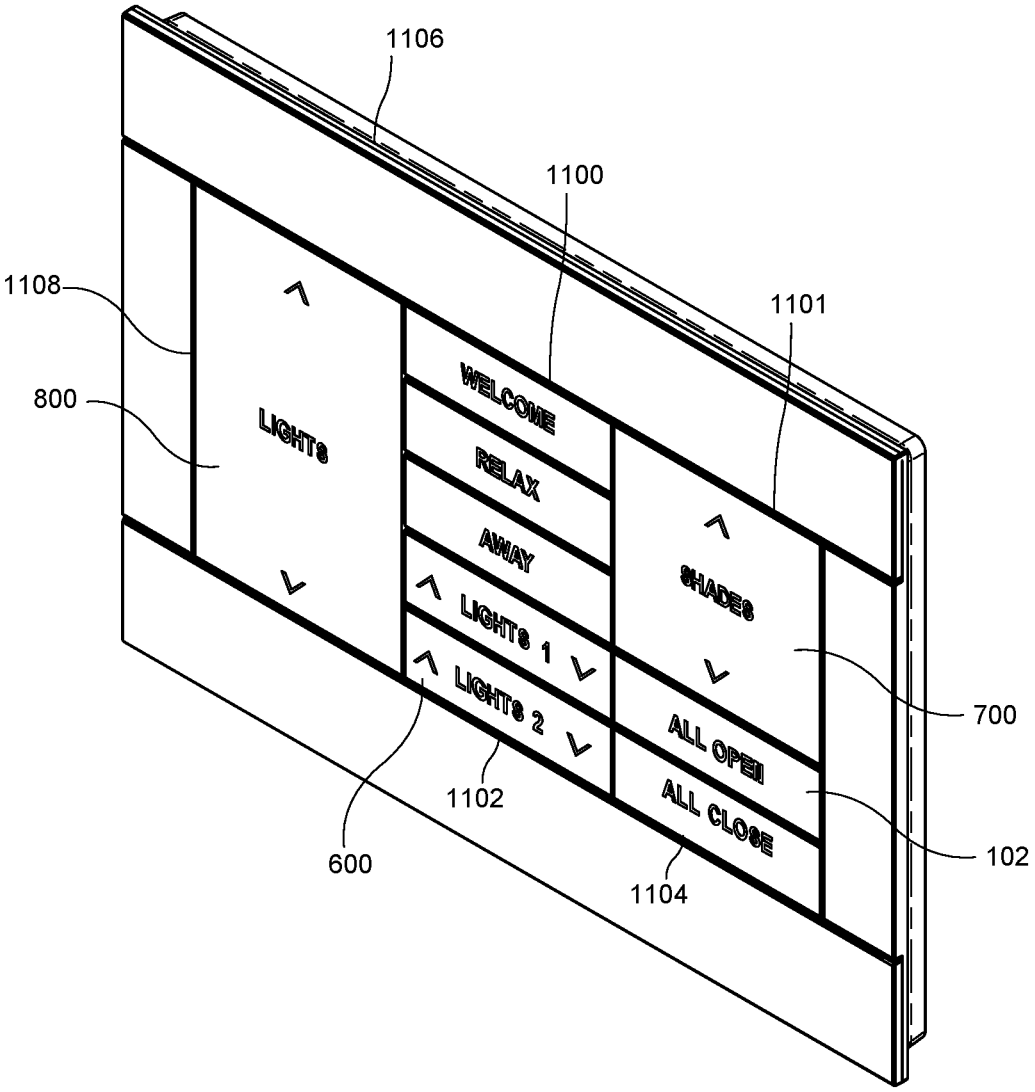

FIG. 11 illustrates a front perspective view of three ganged control devices according to an illustrative embodiment.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims. The detailed description that follows is written from the point of view of a control systems company, so it is to be understood that generally the concepts discussed herein are applicable to various subsystems and not limited to only a particular controlled device or class of devices.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" or "in an embodiment" in various places throughout the specification is not necessarily referring to the same embodiment. Further, the particular feature, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

100 Control Device
101 Housing
102 Buttons
103 Front Surface
106 Faceplate
108 Opening
110 Indicia
202 Vertical Side Walls
203 Horizontal Top Wall
204 Horizontal Bottom Wall
205 Decorative Front Surface
207 Shoulders
209 Trim Plate
210 Front Surface
211 Mounting Holes
212 Screws
213 Screws
217 Opening
218 Lens
301 Front Housing Portion
304 Printed Circuit Board (PCB)
305 Tactile Switches
306 Side Walls
307 Screws
308 Front Wall
309 Openings
310 Openings
311 Light Sources/Light Emitting Diodes (LEDs)
312 Rails
314 Side Edges
315 Light Bars
316 Orifices
317 Light Sensor
318 Orifices
415*a-e* Button Zones
501 Front Wall
502 Side Walls
503 Rear Surface
505 Arms

506 Projection
507 Posts
508 First Post Portion
509 Second Post Portion
510 Abutments
512 Shoulder
513 Pivot Axis
600 Single Height Rocker Button
601 Front Wall
602 Side Walls
603 Rear Surface
605 Arms
606 Projections
607 Posts
610 Abutments
611 Abutments
614 First Pivot Axis
615 Second Pivot Axis
700 Three Height Rocker Button
701 Front Wall
702 Side Walls
703 Rear Surface
705 Arms
706 Projections
707 Posts
710 Abutment
711 Abutments
713 Pivot Axis
800 Five Height Rocker Button
801 Front Wall
802 Side Walls
803 Rear Surface
805 Arms
806 Projections
807 Posts
810 Abutments
811 Abutments
812 Abutments
813 Abutments
814 First Pivot Axis
815 Second Pivot Axis
1002 Two Height Button
1003 Three Height Button
1004 Four Height Button
1005 Five Height Button
1100 Control Device
1102 Set of Buttons
1104 Set of Buttons
1106 Multi Gang Faceplate
1108 Opening

LIST OF ACRONYMS USED IN THE SPECIFICATION IN ALPHABETICAL ORDER

The following is a list of the acronyms used in the specification in alphabetical order.

AC Alternating Current
ASIC Application Specific Integrated Circuit
AV Audiovisual
CPU Central Processing Unit
HVAC Heating, Ventilation and Air Conditioning
IR Infrared
LED Light Emitting Diode
PCB Printed Circuit Board
PoE Power-over-Ethernet
RAM Random-Access Memory
RF Radio Frequency
RISC Reduced Instruction Set Computer
ROM Read-Only Memory

MODE(S) FOR CARRYING OUT THE INVENTION

For 40 years Crestron Electronics, Inc. has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein can be manufactured by Crestron Electronics, Inc., located in Rockleigh, N.J.

The different aspects of the embodiments described herein pertain to the context of wall mounted control devices, but are not limited thereto, except as may be set forth expressly in the appended claims. Referring to FIG. 1, there is shows a perspective front view of an illustrative wall mounted control device 100 according to an illustrative embodiment. The control device 100 may serve as a user interface to associated loads or load controllers in a space. According to an embodiment, the control device 100 may be configured as a keypad comprising a plurality of buttons, such as five single height buttons 102. Each button 102 may be associated with a particular load and/or to a particular operation of a load. For example, different buttons 102 may correspond to different lighting scenes of lighting loads. However, other button configuration may be used as will be described below. As described below, the control device 100 may be configured as a lighting switch or a dimmer having a single button that may be used to control an on/off status of the load. Alternatively, or in addition, the single button can be used to control a dimming setting of the load.

In an illustrative embodiment, the control device 100 may be configured to receive control commands directly from a user via buttons 102 and transmit the control command to a load (such as a light, fan, window blinds, etc.) or to a load controller (not shown) electrically connected the load to control an operation of the load based on the control commands. In various aspects of the embodiments, the control device 100 may control various types of electronic devices or loads. The control device 100 may comprise one or more control ports for interfacing with various types of electronic devices or loads, including, but not limited to audiovisual (AV) equipment, lighting, shades, screens, computers, laptops, heating, ventilation and air conditioning (HVAC), security, appliances, and other room devices. The control device 100 may be used in residential load control, or in commercial settings, such as classrooms or meeting rooms.

Each button 102 may comprise indicia 110 disposed thereon to provide clear designation of each button's function. Each button 102 may be backlit, for example via light emitting diodes (LEDs), for visibility and/or to provide status indication of the button 102. For example, buttons 102 may be backlit by white, blue, or another color LEDs when active. The buttons 102 may comprise opaque material while the indicia 110 may be transparent or translucent allowing light to pass through the indicia 110 and be perceived from the front surface 103 of the button 102. The indicia 110 may be formed by engraving, tinting, printing, applying a film, etching, and/or similar processes. For example, each button 102 may comprise a substantially transparent or translucent material. The front surface 103 of the button 102 may be coated using an opaque material, such as paint, film, tint, or the like. The indicia 110 may then be engraved onto the button 102 exposing the transparent or translucent material.

Reference is now made to FIGS. 1 and 2, where FIG. 2 shows the control device 100 with the faceplate 106 removed. The control device 100 may comprise a housing 101 adapted to house various electrical components of the control device 100, such as the power supply and an electrical printed circuit board (PCB) 304 (FIG. 3). The housing 101 is further adapted to carry the buttons 102 thereon. The buttons 102 may comprise a width wider than the housing 101 (as better shown in FIG. 9B) and are adapted to removably attach to the sides of the housing 101, as will be further described, such that they appear to float on the housing 101. The housing 101 may comprise mounting holes 211 for mounting the control device 100 to a standard electrical box via screws 212. According to another embodiment, control device 100 may be mounted to other surfaces using a dedicated enclosure. According yet to another embodiment, the control device 100 may be configured to sit freestanding on a surface, such as a table, via a table top enclosure.

Once mounted to a wall or an enclosure, the housing 101 may be covered using a faceplate 106. The faceplate 106 may comprise an opening 108 sized and shaped for receiving the buttons 102 therein. The faceplate 106 may be secured to the housing 101 using screws 213. According to an embodiment, the faceplate 106 may comprise a pair of vertical side walls 202 interconnected at their top by a horizontal top wall 203 and at their bottom by a horizontal bottom wall 204. The pair of vertical side walls 202 may each comprise a decorative front surface 205. The horizontal top and bottom walls 204 and 205 may be recessed back from the decorative front surfaces 205 of the vertical side walls 202 forming shoulders 207 therebetween, respectively. Horizontal top and bottom walls 204 and 205 are each adapted to receive a decorative trim plate 209 thereon that covers the screws 213. The decorative trim plates 209 sit recessed in the faceplate 106 via shoulders 207. The trim plates 209 may be removably attached to the top and bottom horizontal walls 204 and 205 using magnets (not shown).

When the control device 100 is fully assembled, as shown in FIG. 1, the front surfaces 103 of the buttons 102, as well as the front surfaces 210 of the trim plates 209, are adapted to be substantially flush with the decorative front surfaces 205 of the pair of vertical side walls 202, resulting in a substantially flat overall front surface. In an illustrative embodiment, the buttons 102, faceplate 106, and trim plates 209 may be fabricated from plastic, where the particular color of the plastic is selected to aesthetically match an overall installation. In another embodiment, the buttons 102 and faceplate 106 may comprise one color and texture, such as a black, white, or almond plastic, while the trim plates 209 may comprise a different color, material, and/or texture. In this configuration, the trim plates 209 may virtually comprise any type of decorative material, such as metal, glass, wood, fabric, leather, marble, stone, composite materials, or the like.

In addition, the control device 100 of the present embodiments does not comprise a bezel frame that surrounds the buttons as in conventional control devices. In addition, the buttons 102 comprise width that is larger than the width of the housing 101 (as shown in FIG. 9B). As such, when a plurality of control devices 100 are ganged next to each other, as shown in FIG. 11, a set buttons 1102 of one control device 1100 are disposed adjacent to a set of buttons 1104 of an adjacent control device 1101, such that there is substantially no space between the adjacent sets of buttons 1102 and 1104. A multi gang faceplate 1106 of the present embodiments comprises substantially the same configuration as a single gang faceplate 106, but with a wider opening 1108 adapted to accommodate a corresponding number of control devices 100. As such, the multi gang faceplate 1106 does not comprise vertical walls between adjacent control devices and their sets of buttons 1102 and 1104, as in conventional control devices. This beneficially creating an overall substantially flat surface across the plurality of ganged control devices. The flat overall surface and the side by side ganging of the control devices 100 of the present embodiments result in an aesthetically pleasing appearance.

Referring now to FIG. 3, which illustrates an exploded view of the control device 100. Housing 101 of control device 100 may comprise a front housing portion 301 and a rear housing portion 302. The rear housing portion 302 may fit within a standard electrical or junction box and may be adapted to contain various electrical components, for example on a printed circuit board (PCB) 304, configured for providing various functionality to the control device 100, including for receiving commands and transmitting commands wirelessly to a load or a load controlling device. The rear housing portion 302 may house a power supply (not shown) for providing power to the various circuit components of the control device 100. The control device 100 may be powered by an electric alternating current (AC) power signal from an AC mains power source. Such control device 100 may comprise leads suitable for making line voltage connections. In another embodiment, the control device 100 may comprise flying leads to connect to 0-10V wires. In yet another embodiment, the control device 100 may be powered using Power-over-Ethernet (PoE) and may comprise a PoE interface, such as via a Cresnet® port. Cresnet® provides a network wiring solution for Crestron® keypads, lighting controls, thermostats, and other devices. The Cresnet® bus offers wiring and configuration, carrying bidirectional communication and 24 VDC power to each device over a simple 4-conductor cable. However, other types of connections or ports may be utilized.

The printed circuit board 304 may include a controller comprising one or more central processing units (CPU), memories, communication interfaces, or the like. The CPU can represent one or more microprocessors, such as "general purpose" microprocessors, a combination of general and special purpose microprocessors, or application specific integrated circuits (ASICs). Additionally, or alternatively, the CPU can include one or more reduced instruction set (RISC) processors, video processors, or related chip sets. The CPU can provide processing capability to execute an operating system, run various applications, and/or provide processing for one or more of the techniques and functions described herein. The memory may be communicably coupled to the CPU and can store data and executable code. The memory can represent volatile memory such as random-access memory (RAM), and/or nonvolatile memory, such as read-only memory (ROM) or Flash memory. In buffering or caching data related to operations of the CPU, the memory can store data associated with applications running on the CPU.

The one or more communication interfaces on PCB 304 may comprise a wired or a wireless communication interface, configured for transmitting control commands to various connected loads or electrical devices. A wireless interface may be configured for bidirectional wireless communication with other electronic devices over a wireless network. In various embodiments, the wireless interface can comprise a radio frequency (RF) transceiver, an infrared (IR) transceiver, or other communication technologies known to those skilled in the art. In one embodiment, the wireless interface communicates using the infiNET EX® protocol from Crestron Electronics, Inc. of Rockleigh, N.J. infiNET EX® is an extremely reliable and affordable protocol that employs steadfast two-way RF communications throughout a residential or commercial structure without the need for physical control wiring. In another embodiment, communication is employed using the ZigBee® protocol from ZigBee Alliance. In yet another embodiment, the wireless communication interface may communicate via Bluetooth transmission. A wired communication interface may be configured for bidirectional communication with other devices over a wired network. The wired interface can represent, for example, an Ethernet or a Cresnet® port. In various aspects of the embodiments, control device 100 can both receive the electric power signal and output control commands through the PoE interface.

The front surface of the PCB 304 may comprise a plurality of micro-switches or tactile switches 305. For example, the PCB 304 may contain fifteen tactile switches 305 arranged in three columns and five rows to accommodate various number of button configurations as discussed below. However, other number of switches and layouts may be utilized to accommodate other button configurations. The tactile switches 305 are adapted to be activated via buttons 102 to receive user input. The PCB 304 may also comprise orifices 318 at various locations on the PCB 304 for providing alignment points for the buttons 102 as described below.

The PCB 304 may further comprise a plurality of light sources 311, such as light emitting diodes (LEDs), configured for providing backlighting to corresponding buttons 102. The plurality of LEDs 311 may be powered using LED drivers located on PCB 304. According to an embodiment, a pair of light sources 311 may be located on two opposite sides of each row of tactile switches 305. The PCB 304 may further comprise a light sensor 317 configured for detecting and measuring ambient light. Light sensor 317 may be used to control the lighting levels of the light sources 311 based on the measured ambient light. According to an embodiment, light sensor 317 may impact the brightness levels of the light sources 311 to stay at the same perceived level based on the measured ambient light levels. A light curve may be used to adjust the brightness of the light sources 311 based on measured ambient light levels by the light sensor 317. According to another embodiment, threshold values may be used. According to yet another embodiment, where multi-colored light sources 311 are used, light sensor 317 may impact the color of the light sources 311 based on the measured ambient light levels. Referring to FIG. 2, the faceplate 106 may comprise an opening 217 adapted to contain a lens 218. Lens 218 may direct ambient light from a side edge of the faceplate 106 toward the light sensor 317. The lens 218 may be hidden from view by the trim plate 209. The PCB 304 may comprise other types of sensors, such as motion or proximity sensors.

The control device 100 may further comprise a plurality of horizontally disposed rectangular light pipes or light bars 315 each adapted to be positioned adjacent a respective row of tactile switches 305 and between a respective pair of light sources 311. For example, each light bar 315 may be positioned above a respective row of tactile switches 305, as shown in FIG. 4. According to one embodiment, the light bars 315 may be individually attached to the front surface of the PCB 304, for example, using an adhesive. According to another embodiment, the light bars 315 may be interconnected into a single tree structure as shown in FIG. 3 and adapted to be attached within the housing 101 via screws 307. Each light bar 315 is configured for distributing and diffusing light from the respective pair of light sources 311 to an individual button 102 for uniform illumination as well as reduced shadowing and glare. Light bars 315 may be fabricated from optical fiber or transparent plastic material such as acrylic, polycarbonate, or the like. Each pair of oppositely disposed light sources 311 may extend out of the front surface of the PCB 304 and may be configured to direct light to opposite side edges 314 of a respective light bar 315. As such, when a pair of light sources 311 are turned on, light is distributed by the light bar 315 from its side edges 314 and out of its front surface to be directed through the indicia 110 of the respective button 102.

The front housing portion 301 is adapted to be secured to the rear housing portion 302 using screws 307 such that the PCB 304 and light bars 315 are disposed therebetween. The front housing portion 301 comprises a front wall 308 with a substantially flat front surface. The front wall 308 may comprise a plurality of openings 309 extending traversely therethrough aligned with and adapted to provide access to the tactile switches 305 as shown in FIG. 4. Front wall 308 may further comprise rectangular horizontal openings 310 extending traversely therethrough aligned with and sized to surround at least a front portion of a respective light bar 315. The front housing portion 301 may comprise an opaque material, such as a black colored plastic or the like, that impedes light transmission through the front wall 308 to prevent light bleeding from one set of light bar 315 and corresponding light sources 311 to another set. In addition, the front wall 308 may further comprise a plurality of orifices 316 extending therethrough at corresponding locations as orifices 318 on the PCB 304 to provide alignment points to the buttons 102.

The front housing portion 301 may further comprise a pair of rails 312 extending out of the front surface of the front wall 308 at its two opposite side edges. In addition, the front housing portion 301 may comprise a pair of side walls 306 orthogonally extending from side edges of the front wall 308, and from its rear surface. Each side wall 306 may comprise at least one shoulder 319 recessed in the side wall 306. According to one embodiment, each side wall 306 may comprise a single shoulder extending along the length of the side wall 306. According to another embodiment, as shown in FIG. 3, each side wall 306 may comprise a plurality of recessed shoulders 319. For example, to accommodate five buttons as discussed below, six recessed shoulders 319 may be provided.

Referring to FIG. 4, there is shown a perspective view of the control device 100 with the buttons 102 removed. The control device 100 defines a plurality of button zones 415*a-e* adapted to receive a plurality of rows of possible height buttons. Particularly, each button zone 415*a-e* may be configured to receive a single height button 102. For example, the control device 100 is shown containing five button zones 415*a-e* adapted to receive five single height buttons, but it may comprise any other number of button zones. According to an embodiment, each button zone 415*a-e* comprises a row of one or more tactile switches 305, one or more button alignment orifices 316, a light bar 315, and a pair of corresponding light sources 311. According to an embodiment shown in FIG. 4, each button zone 415*a-e* may comprise a row of three tactile switches 305. The two side switches 305 of each button zone 415*a-e* may be used for a left/right rocker function, while the center switch 305 of each button zone 415*a-e* may be used for a single press button or be part of an up/down rocker function, as discussed below. In addition, backlighting of each button zone 415*a-e* may be independently controllable. Because the button zones 415*a-e* are isolated and masked using the front housing portion 301, backlighting of one zone does not bleed into the adjacent zones. Additionally, each light bar 315 is adapted to be disposed in substantially the center of the respective button zone 415*a-e* and comprises a width that spans substantially the width of the front wall 308 of the front housing portion 301 such that the indicia 110 on the corresponded button 102 is backlighted evenly. The row of tactile switches 305 of each zone may be disposed below the respective light bar 315, while the alignment orifices 316 may be disposed above the respective light bar 315 and/or adjacent the respective row of tactile switches 305. However, other arrangements are contemplated by the present embodiments.

Referring to FIG. 10, two or more button zones 415*a-e* may be combined to receive a multi-zone height button, such as a two-zone height button 1002, a three-zone height button 700, a four-zone height button 1004, or a five-zone height button 800. As such, the control device 100 of the present embodiments may interchangeably receive various multi-zone height buttons to provide a vast number of possible configurations, as required by an application, some of which are shown in FIG. 10. Other button assembly configurations are also contemplated by the present embodiments. Additionally, depending on which tactile switches 305 are exposed by a button, the various single or multi-zone button heights may be configured to operate as a single press button, a left/right rocker, or an up/down rocker, as discussed below. According to an embodiment, the various button configurations beneficially share the same circuit board layout shown in FIG. 3 by utilizing one or more of the tactile switches 305. In addition, for buttons that span two or more button zones 415*a-e*, one or more lines of indicia 110 may be included and individually backlit, for example as shown in FIG. 11. Each line of indicia 110 may be aligned with backlighting of any one of the button zone 415*a-e*. For example, referring to FIG. 11, a three-zone height button 700 may comprise three lines of indicia, each individually backlit by a respective zone. A five-zone height button 800 may also comprise three lines of individually backlit indicia, while backlighting of zones containing no indicia may be unused.

Referring to FIGS. 5A-5D, there is shown an exemplary single press single height button 102, where FIG. 5A shows a front perspective view of the single height button 102, FIG. 5B shows a rear perspective view of the single height button 102, FIG. 5C shows a top view of the single height button 102, and FIG. 5D shows a side view of the single height button 102. The button 102 may comprise a front wall 501 comprising the front surface 103 and a rear surface 503. A pair of side walls 502 may transversely or laterally extend from the side edges of the front wall 501 away from the rear surface 503. Each side wall 502 of button 102 may comprise a pair of arms 505 transversely and inwardly extending from a terminal end of the side wall 502. The button 102 may further comprise a pair of posts 507 transversely extending from the rear surface 503 of the front wall 501 adjacent to the top edge of the front wall 501. Each post 507 may comprise a first post portion 508 and a second post portion 509 extending from the first port portion 508. According to an embodiment, the second post portion 509 may comprise a smaller diameter than the first post portion 508 defining a shoulder 512 therebetween. The first post portion 508 may be shaped and sized to be received by the orifice 316 in the front wall 308 of the front housing portion 301. The second post portion 509 may be shaped and sized to be received by the orifice 318 in the PCB 304. The button 102 may also comprise a projection 506 transversely extending from its rear surface 503 at the horizontal center of the button 102 adjacent to the bottom edge of the front wall 501. The projection 506 is adapted to depress a least one tactile switch 305 located on the PCB 304. In addition, the button 102 may comprise a pair of oppositely disposed and aligned abutments 510 transversely extending from its rear surface 503 adjacent the side walls 502 in proximity to the vertical center of the front wall 501. The pair of abutments 510 are adapted to provide a horizontal pivot axis 513. According to another embodiment, a single longitudinal abutment may be instead provided.

Referring to FIGS. 4, 5A-D, and 9A and 9B, the single press, single height button 102 comprises a height substantially equal to a single button zone 415*a-e* such that it may be attached to the front housing portion 301 at any one of the button zones 415*a-e*. For example, the single height button 102 may be attached to the front housing portion 301 at zone 415*b* by being snapped onto the front housing portion 301. Particularly, each pair of arms 505 on each side wall 502 of button 102 are caused to engage a pair of adjacent shoulders 319 in a respective side wall 306 of the front housing portion 301 that are aligned with zone 415*b*, such that the button 102 hugs side walls 306 of the front housing portion 301, as shown in FIG. 9B. The pair of posts 507 are inserted through the pair of alignment orifices 316 located on the front housing portion 301 at zone 415*b* and into respective alignment orifices 318 on the PCB 304. Specifically, the first post portion 508 is inserted through alignment orifices 316 and the second post portion 509 is inserted through alignment orifices 318. This prevents vertical and horizontal displacement of the button 102 out of the zone 415*b*. In addition, the shoulder 512 of each post 507 bias against the front wall 308 of the front housing portion 301 such that the top sides of the button are prevented from being depressed. The center projection 506 will rest against the center tactile switch 305*e* without depressing the switch 305*e*. As such, a single press single height button 102 will expose the center switch 305 of zone 415*b*, while the side switches of zone 415*b* will not be used. The pair of abutments 510 in turn abut against the pair of rails 312. The button 102 may be depressed by a user causing the projection 506 to depress the tactile switch 305 of zone 415*b*, for example to provide an on/off operation. The shoulders 512 of posts 507, as well as abutments 510 will cause the button 102 to slightly pivot about pivot axis 513 in a downward direction. In addition, the pair of oppositely disposed abutments 510 will cause the button 102 to deflect when pressed at a location between the abutments 510.

Referring to FIGS. 6A and 6B, there is shown an exemplary single height rocker button 600, where FIG. 6A shows a front perspective view of the single height rocker button 600 and FIG. 6B shows a rear perspective view of the single height rocker button 600. The rocker button 600 may comprise a similar configuration as the single press, single height button 102, comprising a front wall 601, side walls 602, and arms 605. Rocker button 600 may be configured to expose two side tactile switches 305 of a single zone 415*a-e* to provide a left/right rocking function. Particularly, rocker button 602 may comprise a pair of posts 607 transversely extending from the rear surface 603 of the front wall 601 adjacent to the top edge of the front wall 601. The rocker button 602 may comprise a pair of projections 606 transversely extending from its rear surface 603 adjacent to the side walls 602 and the bottom edge of the front wall 601. In addition, the button 600 may comprise a plurality of abutments 610 and 611 vertically extending from the rear surface 603 of the front wall 601. According to one embodiment, a pair of aligned abutments 610 may vertically extend to provide a first vertical pivot axis 614 and a pair of aligned abutments 611 may vertically extend to provide a second vertical pivot axis 615. Vertical pivot axes 614 and 615 may be parallel to each other and may be disposed in proximity to the horizontal center of the button 600. Although in another embodiment, a single vertical pivot axis may be utilized.

Referring to FIGS. 4 and 6A and 6B, the single height rocker button 600 may be attached to the front housing portion 301 at any one of the button zones 415*a-e*. For example, the single height rocker button 600 may be attached to the front housing portion 301 at zone 415*c* by being snapped onto the front housing portion 301. Particularly, each pair of arms 605 of each side wall 602 of button 600 are caused to engage a pair of adjacent shoulders 319 in a respective side wall 306 of the front housing portion 301 that are aligned with zone 415*c*. The button 600 is aligned with zone 415*c* via the pair of posts 607 that are inserted through the alignment orifices 316 in the front housing portion 301 and the respective alignment orifices 318 on the PCB 304. The pair of projections 606 rest against the side tactile switches 305 in zone 415*c*, while the center switch of that zone is not used. The plurality of center abutments 610 and 611 abut against the front wall 308 of the front housing portion 301.

The left or the right side of the rocker button 600 may be depressed by a user, for example to provide a raise/lower operation. Depressing the left side of the rocker button 600 will cause the left side of the button 600 to slightly pivot and deflect via abutments 611 in a left direction about pivot axis 615. As a result, the left projection 606 will depress the left tactile switch 305. The rocker button 600 may be similarly depressed on the right side, causing the right side of the button 600 to slightly pivot and deflect in the right direction about pivot axis 614 via abutments 610. As a result, the right projection 606 will depress the right tactile switch 305. In addition, abutments 610 also prevent the button 600 from being depressed in the center, such that left and right tactile switches cannot be pressed simultaneously.

Referring to FIGS. 7A and 7B, there is shown an exemplary three height rocker button 700, where FIG. 7A shows a front perspective view of the three height rocker button 700 and FIG. 7B shows a rear perspective view of the three height rocker button 700. The rocker button 700 may comprise a similar configuration as the single press button 102, comprising a front wall 701, side walls 702, and arms 705. Rocker button 700 may comprise a height configured to span over three adjacent button zones. Rocker button 700 may be configured to expose two vertically disposed tactile switches to provide an up/down rocking function. Rocker button 700 may comprise a pair of posts 707 transversely extending from the rear surface 703 of the front wall 701 adjacent to the side walls 702. Posts 707 may be positioned substantially at the vertical center of the front wall 701, in proximity to pivot axis 713. The rocker button 700 may also comprise a pair of projections 706 transversely extending from the rear surface 703 of the front wall 701, along its horizontal center. A first projection 706 may be adjacent the top edge of the front wall 701 and a second projection 706 may be adjacent the bottom edge of the front wall 701. In addition, the button 700 may comprise at least one abutment 710 horizontally extending from its rear surface 703 in proximity to the vertical center of the front wall 701. Abutment 710 may be configured to provide a horizontal pivot axis 713. Additional abutments 711 may be provided in proximity to the side walls 702.

Referring to FIGS. 4 and 7A and 7B, the three height rocker button 700 may be attached to the front housing portion 701 over any combination of three adjacent button zones 415*a-e*. For example, the three height rocker button 700 may be attached to the front housing portion 301 over zones 415*c*, 415*d*, and 415*e* by being snapped onto the front housing portion 301. Particularly, each pair of arms 705 on each side wall 702 of the button 700 are caused to engage a pair of shoulders 319 in the side walls 306 of the front housing portion 301. According to an embodiment, each pair of arms 705 may engage the uppermost shoulder 319 in zone 415*c* and the bottommost shoulder 319 in zone 415*e*. Although the arms 705 may be configured to engage other shoulders 319 in zones 415*c*, 415*d*, or 415*e*. The button 700 is aligned with zones 415*c-e* via the pair of posts 707 that are inserted through the alignment orifices 316 in the front housing portion 301 and the respective alignment orifices 318 on the PCB 304. The pair of projections 706 may rest against the uppermost tactile switch 305 located in zone 415*c* and the bottommost tactile switch 305 located in zone 415*e*, while the remaining switches will not be used. The at least one center abutment 710 abuts against the front wall 308 of the front housing portion 301.

The upper or bottom side of the rocker button 700 may be depressed by the user, for example to provide a raise/lower operation. Pressing the upper side of the rocker button 700 will cause the upper side of the rocker button 700 to slightly pivot and deflect in an upward direction about pivot axis 713 via abutment 710. This will cause the top projection 706 to depress the top tactile switch 305 in zone 415*c*. Similarly, pressing the bottom side of the rocker button 700 will cause the bottom side of the rocker button 700 to slightly pivot and deflect in a downward direction about pivot axis 713 via abutment 710. As such, the bottom projection 706 will depress the bottom tactile switch 305 in zone 415*e*. The at least one abutment 710 will also prevent the button 700 from being depressed in the center, such that upper and lower tactile switches 305 cannot be pressed simultaneously. Additional pivot abutments 710 and/or side abutments 711 may be provided for stability.

As another example, FIGS. 8A and 8B illustrate an exemplary five height rocker button 800, where FIG. 8A shows a front perspective view of the five height rocker button 800 and FIG. 8B shows a rear perspective view of the five height rocker button 800. The rocker button 800 may comprise a similar configuration as the single press button 102, comprising a front wall 801, side walls 802, and arms 805. Rocker button 800 may comprise a height adapted to cover all five button zones 415*a-e* such that the control device 100 comprises a single button. Rocker button 800 may be configured to expose two vertically disposed tactile switches to provide an up/down rocking function. Rocker button 802 may comprise a pair of posts 807 transversely extending from the rear surface 803 of the front wall 801 adjacent to the side walls 802 substantially at the vertical center of the front wall 801. The rocker button 800 may comprise a pair of projections 806 transversely extending from a horizontal center of its rear surface 803. A first projection 806 may extend adjacent the top edge of the front wall 801 and a second projection 806 may extend adjacent the bottom edge of the front wall 801. In addition, the button 800 may comprise a plurality of parallel abutments 810-812 horizontally extending from the rear surface 803 of the front wall 801 in proximity to the vertical center of the front wall 801. According to one embodiment, the upper abutment 810 may be adapted to provide a first horizontal pivot axis 814 and the lower abutment 811 may be adapted to provide a second pivot axis 815. Additional horizontal abutments 812 may be disposed between the first and second horizontal abutments 810 and 811 for stability. Although in other embodiments, a single pivot axis may be provided via a single horizontal abutment. Additional abutments 813 may be provided in proximity to the side walls 802.

Referring to FIGS. 4 and 8A and 8B, the five height rocker button 800 may be attached to the front housing portion 301 over all of the five button zones 415*a-e* by being snapped onto the front housing portion 301. The arms 805 of the button 800 will engage a pair of aligned shoulders 319 in the side walls 306 of the front housing portion 301. The button 800 may be aligned with zones 415*a-e* via the pair of posts 807 that are inserted through alignment orifices 316 in the front housing portion 301 and the respective alignment orifices 318 on the PCB 304. Although, other alignment orifices may be used. The upper projection 806 will rest against the uppermost tactile switch 305 located in zone 415*a*, while the lower projection 806 will rest against the bottommost tactile switch 305 located in zone 415*e*. The remainder of the switches will not be used. Abutments 810 and 811 are adapted to abut against the front wall 803 of the front housing portion 301 to provide pivoting axes 814 and 815 to rocker button 800. Abutments 812 and 813 may also abut the front wall 803 to provide additional stability to the rocker button 800.

The upper or bottom side of the rocker button 800 may be depressed by the user, for example to provide a raise/lower operation. Depressing the upper side of the button 800 will cause it to slightly pivot and deflect in an upward direction about pivot axis 814 via abutment 810. As such the top projection 806 will depress the top tactile switch. Similarly, depressing the bottom side of the button 800 will cause it to slightly pivot and deflect in a downward direction about pivot axis 815 via abutment 811, thereby causing the bottom projection 806 to depress the bottom tactile switch. The plurality of horizontal abutments 810-812 will also prevent the button 800 from being depressed in the center, such that upper and lower tactile switches 305 cannot be pressed simultaneously.

While not shown, the two and four height button configurations (1002 and 1004, FIG. 10) may be configured in a similar fashion as discussed above.

The wall-mounted control device 100 can be configured in the field, such as by an installation technician, in order to accommodate many site-specific requirements. Field configuration can include selection and installation of an appropriate button configuration based on the type of load, the available settings for the load, etc. Advantageously, such field configurability allows an installation technician to adapt the electrical device to changing field requirements (or design specifications). Beneficially, the buttons are field replaceable without removing the device from the wall. After securing the buttons 102 on the control device 100, the installer may program the button configuration through tapping all of the placed buttons. The configured buttons can then be assigned to a particular load or a load function.

INDUSTRIAL APPLICABILITY

The disclosed embodiments provide an apparatus, system, and method for a wall mounted control device with interchangeable buttons. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

Additionally, the various methods described above are not meant to limit the aspects of the embodiments, or to suggest that the aspects of the embodiments should be implemented following the described methods. The purpose of the described methods is to facilitate the understanding of one or more aspects of the embodiments and to provide the reader with one or many possible implementations of the processed discussed herein. The steps performed during the described methods are not intended to completely describe the entire process but only to illustrate some of the aspects discussed above. It should be understood by one of ordinary skill in the art that the steps may be performed in a different order and that some steps may be eliminated or substituted.

All United States patents and applications, foreign patents, and publications discussed above are hereby incorporated herein by reference in their entireties.

ALTERNATE EMBODIMENTS

Alternate embodiments may be devised without departing from the spirit or the scope of the different aspects of the embodiments.

What is claimed is:

1. A control device adapted to control at least one function of at least one associated load comprising:

a housing assembly comprising:

a front wall comprising at least one switch opening extending traversely therethrough and at least one first button alignment orifice extending through the front wall of the housing assembly; and a pair of side walls laterally and rearwardly extending from side edges of the front wall, wherein each side wall comprises at least one recessed shoulder;

a printed circuit board adapted to be disposed within the housing assembly behind the housing front wall and comprises a plurality of switches adapted to be received within the switch openings in the housing front wall, wherein the printed circuit board further comprises a plurality of second button alignment orifices traversely extending therethrough and each adapted to align with at least one of the first button alignment orifices, wherein the second button alignment orifices comprise a smaller diameter than a diameter of the first button alignment orifices;

a plurality of adjacently disposed buttons each comprising:

a front wall comprising a front surface substantially aligned with a front surface of an adjacently disposed button, wherein the button front wall comprises a first button portion and a second button portion;

a pair of side walls laterally and rearwardly extending from side edges of the button front wall, wherein each button side wall comprises at least one arm laterally and inwardly extending from the button side wall;

at least one alignment post comprising a first post portion extending from a rear surface of the button and a second post portion extending from the first post portion, wherein the second post portion comprises a diameter smaller than a diameter of the first post portion defining a shoulder therebetween, wherein the first post portion is adapted to be aligned with and inserted through at least one of the first alignment orifices in the housing front wall, and wherein the second post portion is adapted to be aligned with and inserted through one of the second alignment orifices in the printed circuit board such the shoulder abuts the printed circuit board;

wherein each button comprises a width wider than the housing assembly, wherein each button is adapted to removably attach to the housing assembly whereby the button side walls envelop the side walls of the housing assembly and the at least one arm on each side wall of the button engages the at least one recessed shoulder in a respective side wall of the housing assembly, and wherein when the first button portion is pressed, the first button portion pivots or deflects toward the housing assembly front wall and engages at least one switch on the housing assembly, and at least one arm of the at least one button side wall proximate to the second button portion engages the respective recessed shoulder in the housing assembly and restricts the front surface of the button front wall at the second button portion from being displaced away from the front surface of the adjacently disposed button.

2. A control device adapted to control at least one function of at least one associated load comprising:

a housing assembly comprising:

a front wall defining a plurality of button zones disposed along the front wall, wherein each button zone comprises at least one switch opening extending traversely therethrough and at least one first button alignment orifice extending through the front wall of the housing assembly, and a pair of side walls each laterally and rearwardly extending from side edges the front wall and comprises at least one recessed shoulder;

a printed circuit board adapted to be disposed within the housing assembly behind the housing front wall and comprises a plurality of switches adapted to be received within the switch openings in the housing front wall such that each button zone comprises at least one of the switches, wherein the printed circuit board further comprises a plurality of second button alignment orifices traversely extending therethrough and each adapted to align with at least one of the first button alignment orifices within each button zone, wherein the second button alignment orifices comprise a smaller diameter than a diameter of the first button alignment orifices;

a plurality of adjacently disposed buttons each comprising:

a front wall comprising a front surface substantially aligned with a front surface of an adjacently disposed button, wherein the button front wall comprises a width wider than the housing assembly, wherein the button front wall comprises a first button portion and a second button portion;

a pair of side walls each laterally and rearwardly extending from side edges of the button front wall and comprises at least one arm laterally and inwardly extending from the side wall, wherein each button removably attaches to the housing assembly over one or more of the button zones whereby the button side walls envelop the side walls of the housing assembly and the at least one arm on each button side wall engages the at least one recessed shoulder in a respective side wall of the housing assembly;

at least one projection extending from a rear surface of the button and adapted to be aligned with at least one switch of one of the button zones to depress the aligned switch when the button is pressed;

at least one alignment post comprising a first post portion extending from the rear surface of the button and a second post portion extending from the first post portion, wherein the second post portion comprises a diameter smaller than a diameter of the first post portion defining a shoulder therebetween, wherein the first post portion is adapted to be aligned with and inserted through at least one of the first alignment orifices of one of the button zones, and wherein the second post portion is adapted to be aligned with and inserted through one of the second alignment orifices in the printed circuit board such the shoulder abuts the printed circuit board;

at least one abutment extending from the rear surface of the button front wall between the first button portion and the second button portion, wherein the button side walls extend from the rear surface of the button at a distance beyond the at least one abutment;

wherein when the first button portion is pressed, the at least one abutment abuts against the front wall of the housing assembly, the first button portion pivots or deflect toward the housing assembly front wall and depresses the aligned switch, and at least one arm of the at least one button side wall proximate to the second button portion engages the respective recessed shoulder in the housing assembly and restricts the front surface of the button front wall at the second button portion from being displaced away from the front surface of the adjacently disposed button;

wherein the buttons comprise a single zone height button comprising a height adapted to substantially cover and attach over a single button zone, and wherein the buttons comprise at least one multi-zone height button adapted to substantially cover and attach over at least two adjacent button zones.

3. The control device of claim 2 further comprising:

a faceplate adapted to attach to the housing assembly and comprising an opening defined by a pair of vertical side walls having a front surface interconnected by a horizontal top wall and a horizontal bottom wall, wherein the faceplate opening is wider than the width of the front wall of the plurality of buttons such that the front wall of the plurality of buttons is received within the faceplate opening and the front surface of the plurality of buttons is substantially aligned and flush with the front surface of the pair of vertical side walls of the faceplate.

4. The control device of claim 3, wherein the horizontal top wall and the horizontal bottom wall of the faceplate are recessed back from the pair of vertical side walls of the faceplate and each is adapted to removably receive a decorative trim plate thereon, wherein a front surface of each button is adapted to be substantially flush with a front surface of the pair of vertical side walls of the faceplate and a front surface of each decorative trim plate.

5. The control device of claim 2, wherein each side wall of the housing assembly comprises a plurality of recessed shoulders each aligned with one of the button zones.

6. The control device of claim 2, wherein each button zone comprises at least one light source and wherein each button comprises an opaque area and a transparent or translucent area adapted to permit light from the light source to pass therethrough.

7. The control device of claim 6 further comprises a plurality of longitudinally extending light bars each positioned adjacent the at least one light source at one of the button zones, wherein the front wall of the housing assembly comprises a plurality of openings extending traversely therethrough and each sized to receive at least a front portion of one of the light bars, wherein each light bar comprises a material adapted to distribute light from the respective at least one light source.

8. The control device of claim 7, wherein the at least one light source at one of the button zones comprises a pair of oppositely disposed light sourced aligned with and adapted to direct light to side edges of a rear portion of the one of the light bars.

9. The control device of claim 2, wherein the printed circuit board comprises at least one light source adapted to provide backlighting to the button zone.

10. The control device of claim 2, wherein at least one of the buttons comprises a single press button adapted to depress one of the at least one switches in one of the button zones.

11. The control device of claim 2, wherein at least one of the buttons comprises a rocker bottom adapted to depress two switches in at least one of the button zones.

12. The control device of claim 2, wherein at least one of the buttons comprises a single zone height button adapted to cover and attach over a single button zone.

13. The control device of claim 12, wherein at least one of the buttons comprises a multi-zone height button adapted to cover and attach over at least two adjacent button zones.

14. The control device of claim 13, wherein the multi-zone height button comprises a multi-zone single press button adapted to depress one of the switches in one of the button zones.

15. The control device of claim 13, wherein the multi-zone height button comprises a multi-zone rocker button adapted to depress two switches in two different button zones.

16. The control device of claim 13, wherein the single zone and multi-zone height buttons are interchangeably received by the one or more of the button zones to provide a plurality of button configurations.

17. The control device of claim 2, wherein the at least one abutment comprises a pair of oppositely disposed abutments adapted to cause the at least one button to deflect when pressed at a location between the abutments.

18. The control device of claim 2, wherein the at least one abutment on at least one button longitudinally extends along a horizontal pivot axis adapted to cause at least one side of the at least one button to pivot or deflect about the horizontal pivot axis when pressed.

19. The control device of claim 2, wherein the at least one abutment on at least one button longitudinally extends along a vertical pivot axis adapted to cause at least one side of the at least one button to pivot or deflect about the vertical pivot axis when pressed.

20. The control device of claim 2, wherein the housing assembly further comprises a rear housing portion attached to a front housing portion, wherein the rear housing portion is adapted to fit within a standard electrical box.

* * * * *